US008252392B2

(12) United States Patent
Oguri et al.

(10) Patent No.: US 8,252,392 B2
(45) Date of Patent: Aug. 28, 2012

(54) RECORDING MEDIUM

(75) Inventors: Isamu Oguri, Yokohama (JP); Hisao Kamo, Ushiku (JP); Yasuhiro Nito, Yokohama (JP); Tetsuro Noguchi, Hachioji (JP); Ryo Taguri, Kawasaki (JP); Olivia Herlambang, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 151 days.

(21) Appl. No.: 12/901,099

(22) Filed: Oct. 8, 2010

(65) Prior Publication Data

US 2011/0104411 A1 May 5, 2011

(30) Foreign Application Priority Data

Nov. 5, 2009 (JP) ..... 2009-253937

(51) Int. Cl.
*B41M 5/00* (2006.01)

(52) U.S. Cl. ..... 428/32.24; 428/32.25; 428/32.34; 428/198; 428/327

(58) Field of Classification Search ..... 428/32.24, 428/32.25, 32.34, 198, 327
See application file for complete search history.

(56) References Cited

U.S. PATENT DOCUMENTS

| | | | | |
|---|---|---|---|---|
| 5,955,185 | A | 9/1999 | Yoshino et al. | |
| 5,965,252 | A | 10/1999 | Santo et al. | |
| 6,874,881 | B2 | 4/2005 | Shirota et al. | |
| 6,929,362 | B2 | 8/2005 | Takada et al. | |
| 6,932,465 | B2 | 8/2005 | Nito et al. | |
| 6,935,732 | B2 | 8/2005 | Takada et al. | |
| 7,029,109 | B2 | 4/2006 | Shirota et al. | |
| 7,055,943 | B2 | 6/2006 | Suzuki et al. | |
| 7,208,032 | B2 | 4/2007 | Hakamada et al. | |
| 7,276,110 | B2 | 10/2007 | Tsujimura et al. | |
| 7,276,112 | B2 | 10/2007 | Tokuda et al. | |
| 7,347,890 | B2 | 3/2008 | Nito et al. | |
| 7,354,145 | B2 | 4/2008 | Nito et al. | |
| 7,377,631 | B2 | 5/2008 | Takada et al. | |
| 7,402,200 | B2 | 7/2008 | Imai et al. | |
| 7,517,073 | B2 | 4/2009 | Nito et al. | |
| 7,517,074 | B2 | 4/2009 | Hakamada et al. | |
| 7,537,329 | B2 | 5/2009 | Nito et al. | |
| 7,625,614 | B2 | 12/2009 | Kamo et al. | |
| 7,635,182 | B2 | 12/2009 | Hakamada et al. | |
| 7,846,516 | B2 | 12/2010 | Kamo et al. | |
| 7,867,586 | B2 | 1/2011 | Kamo et al. | |
| 2001/0055055 | A1* | 12/2001 | Eguchi et al. | 347/105 |
| 2002/0192436 | A1* | 12/2002 | Voeght et al. | 428/195 |
| 2008/0152827 | A1 | 6/2008 | Hakamada et al. | |
| 2009/0233065 | A1* | 9/2009 | Komatsu | 428/195.1 |
| 2011/0008553 | A1 | 1/2011 | Hyakuda et al. | |

FOREIGN PATENT DOCUMENTS

| | | | |
|---|---|---|---|
| EP | 0701904 | A1 | 3/1996 |
| JP | 58-113927 | A | 7/1983 |
| JP | 5-16015 | B2 | 3/1993 |
| JP | 7-76162 | A | 3/1995 |
| JP | 7-232473 | A | 9/1995 |
| JP | 8-132731 | A | 5/1996 |
| JP | 9-66664 | A | 3/1997 |
| JP | 9-76628 | A | 3/1997 |
| JP | 2000-108503 | A | 4/2000 |

OTHER PUBLICATIONS

Jan. 25, 2012 European Search Report in European Patent Appln. No. 10014134.0.

U.S. Appl. No. 12/950,421, filed Nov. 19, 2010, Isamu Oguri, et al.

U.S. Appl. No. 12/995,017, filed Nov. 29, 2010, Hirokazu Hyakuda, et al.

* cited by examiner

*Primary Examiner* — Betelhem Shewareged

(74) *Attorney, Agent, or Firm* — Fitzpatrick, Cella, Harper & Scinto

(57) ABSTRACT

The invention provides a recording medium comprising a substrate and an ink receiving layer that is provided on the substrate and contains alumina hydrate and a binder. A surface of the ink receiving layer is covered with a partial coating formed by a plurality of coatings containing a cationic polyurethane. The plurality of coatings have an average major diameter of 0.03 μm or more and less than 1.00 μm. The partial coating provides a coverage of 10% or more and less than 70% with respect to the surface of the ink receiving layer.

2 Claims, No Drawings

RECORDING MEDIUM

BACKGROUND OF THE INVENTION

1. Field of the Invention

The present invention relates to a recording medium such as an ink jet recording medium.

2. Description of the Related Art

An ink jet recording medium is required to have high color developability and surface gloss as well as excellent appearance and storability. In addition, the recording medium is also strongly required to have excellent ink absorbency with increasing printing speed due to recent improvement in performances of printers. In order to meet such requirements, various improvements in the structure and properties of a recording medium have been vigorously attempted.

In order to achieve both ink absorbency and surface gloss at the same time, it is known to provide a layer of fine silica particles on an ink receiving layer by a coating method without applying a pressure which reduces voids of the ink receiving layer (see Japanese Patent Application Laid-Open No. H07-76162). In order to achieve higher surface gloss, it is also known to provide a layer containing a resin as a main component on an ink receiving layer (see Japanese Patent Application Laid-Open No. 2000-108503).

From the viewpoint of ink absorbency which enables higher printing speed, such an inorganic pigment as finer silica particles and alumina hydrate particles which are bound by a polymer binder such as polyvinyl alcohol has come to be used in an ink receiving layer of an ink jet recording medium. Among the inorganic pigments, fine particles of alumina hydrate can form a receiving layer with a less amount of a binder, and so the receiving layer is excellent in ink absorbency.

SUMMARY OF THE INVENTION

The present inventors have found the following invention. According to the present invention, there is thus provided a recording medium comprising a substrate and an ink receiving layer that is provided on the substrate and contains alumina hydrate and a binder, wherein a surface of the ink receiving layer is covered with a partial coating formed by a plurality of coatings containing a cationic polyurethane, the plurality of coatings have an average major diameter of is 0.03 μm or more and less than 1.00 μm, and the partial coating provides a coverage of 10% or more and less than 70% with respect to the surface of the ink receiving layer.

DESCRIPTION OF THE EMBODIMENTS

According to the method of Japanese Patent Application Laid-Open No. H07-76162, some glossy appearance can be given to the surface while retaining high absorbency. However, a gloss developing effect comparable with that of a silver salt photograph may not be achieved in some cases. According to the method of Japanese Patent Application Laid-Open No. 2000-108503, plenty of resin is absorbed in the ink receiving layer, so that the pores in the ink receiving layer may be filled with the resin in some cases to fail to ensure ink absorbency.

The present invention will now be described in more detail by preferred embodiments.

<<Recording Medium>>

The recording medium according to the present invention has a substrate, an ink receiving layer and a partial coating. The recording medium according to the present invention can be used as an ink jet recording medium. The ink receiving layer is favorably porous. Incidentally, the ink receiving layer may be located between the substrate and the partial coating. The partial coating covers the surface of the ink receiving layer and is located at the outermost surface of the recording medium. The recording medium has at least one ink receiving layer on the substrate. The partial coating is formed by a plurality of coatings containing a cationic polyurethane. The partial coating can be formed by, for example, using an emulsion of a cationic polyurethane having an average particle size of 0.01 μm or more and 0.10 μm or less as a coating liquid and applying and drying this coating liquid. In other words, the partial coating may be a solid body of the cationic polyurethane emulsion. The average major diameter of the plural coatings is 0.03 μm or more and less than 1.00 μm, and the coverage of the surface of the ink receiving layer by the partial coating is 10% or more and less than 70%.

<Substrate>

No particular limitation is imposed on the substrate used in the recording medium according to the present invention, and paper such as wood free paper, medium grade paper, coat paper, art paper or cast-coated paper, synthetic paper, a white plastic film, a transparent plastic film, a translucent plastic film, or resin-coated paper may be used. When the gloss of an image formed is to be effectively developed, a substrate with high barrier properties to a coating liquid for forming the ink receiving layer is favorable, and a white plastic film of polyethylene terephthalate, polyvinyl chloride, polycarbonate, polyimide, polyacetate, polyethylene, polypropylene or polystyrene, which has been opacified by blending a pigment such as titanium oxide or barium sulfate and imparting porosity, or the so-called resin-coated paper obtained by laminating a thermoplastic resin such as polyethylene or polypropylene on base paper is favorable as the substrate.

When image quality and feel comparable with those of a silver salt photograph are intended to be achieved by the recording medium, examples of base paper favorably used as the substrate include the following. More specifically, polyolefin-resin-coated paper in which at least one surface, on which the ink receiving layer is provided, is coated with a polyolefin resin is favorable, and polyolefin-resin-coated paper both surfaces of which are coated with the polyolefin resin is more favorable. A favorable mode of the polyolefin-resin-coated paper is one having a 10-point average roughness of 0.5 μm or less according to JIS B 0601 and a 60°-specular glossiness of 25% or more and 75% or less according to JIS Z 8741.

The thickness of the resin-coated paper is favorably 25 μm or more and 500 μm or less. When the thickness of the resin-coated paper is 25 μm or more, it can be well prevented that the stiffness of the resulting recording medium becomes low, and that such inconveniences as deteriorated feel and texture when the recording medium is touched with a hand and lowered opacity are caused. When the thickness of the resin-coated paper is 500 μm or less on the other hand, it can be well prevented that the resulting recording medium becomes rigid and hard to handle, so that paper feeding and conveyance in a printer can be smoothly conducted. The thickness of the resin-coated paper is more favorably within a range of 50 μm or more and 300 μm or less. No particular limitation is imposed on the basis weight of the resin-coated paper. However, the basis weight is favorably within a range of 25 $g/m^2$ or more and 500 $g/m^2$ or less.

<Ink Receiving Layer>

The ink receiving layer used in the present invention contains alumina hydrate and a binder for forming a porous structure and satisfying high-speed absorbency, dye fixability, transparency, printing density, color developability and glossiness. The ink receiving layer can be obtained by, for example, applying a coating liquid (hereinafter referred to as a coating liquid for ink receiving layers) containing alumina hydrate and a binder and may be a solid body of the coating liquid. Incidentally, the ink receiving layer may be formed of one layer or 2 or more layers. In all of these cases, each layer favorably satisfies the following conditions.

The coating amount of the ink receiving layer used in the present invention is favorably 5 g/m$^2$ or more and 50 g/m$^2$ or less in terms of coating amount (dry coating amount) though it varies according to a necessary ink absorption capacity, glossiness and the composition of the receiving layer. When the coating amount is 5 g/m$^2$ or more, it can be well prevented that the ink absorbency of the resulting ink receiving layer becomes low. When the coating amount is 50 g/m$^2$ or less, it can be well prevented that the fold crack resistance of the resulting ink receiving layer becomes low.

Alumina Hydrate

In the present invention, the ink receiving layer contains alumina hydrate for forming a porous structure and satisfying high-speed absorbency, dye fixability, transparency, printing density, color developability and glossiness.

Alumina hydrate that is favorably used, for example, is represented by the following formula (X):

$$Al_2O_{3-n}(OH)_{2n}\cdot mH_2O \quad (X)$$

wherein n is any one of 1, 2 and 3, and m is a number of 0 or more and 10 or less, favorably 0 or more and 5 or less, with the proviso that n and m are not 0 at the same time.

In many cases, $mH_2O$ represents an aqueous phase, which does not participate in the formation of a crystal lattice, but is illimitable. Therefore, m may take a value of an integer or a value other than the integer. When the alumina hydrate is heated, m may reach a value of 0 in some cases.

The crystal structure of alumina hydrate, is known to be amorphous, gibbsite and boehmite according to the temperature of the heat treatment. That having any crystal structure among these may be used.

Among these, favorable alumina hydrate is alumina hydrate exhibiting a boehmite structure or amorphous structure when analyzed by the X-ray diffractometry. As specific examples thereof, may be mentioned the alumina hydrates described in Japanese Patent Application Laid-Open No. H07-232473, Japanese Patent Application Laid-Open No. H08-132731, Japanese Patent Application Laid-Open No. H09-66664 and Japanese Patent Application Laid-Open No. H09-76628. In addition, commercially available DISPERAL HP14 (trade name, product of Sasol Co.) may be mentioned as the alumina hydrate. Incidentally, 2 or more kinds of alumina hydrates may be used in combination. That giving an average pore radius of 7.0 nm or more and 15.0 nm or less to the resulting ink receiving layer is favorably used. That giving an average pore radius of 8.0 nm or more and 15.0 nm or less in the resulting ink receiving layer is more favorably used. When the average pore radius of the ink receiving layer is 7.0 nm or more and 15.0 nm or less, the ink receiving layer can exhibit excellent ink absorbency and color developability. When the average pore radius of the ink receiving layer is 7.0 nm or more, it can be well prevented that the ink absorbency of the ink receiving layer becomes low, and so excellent ink absorbency can be achieved by controlling the amount of the binder to the alumina hydrate as needed. When the average pore radius of the ink receiving layer is 10.0 nm or less, it can be well prevented that the haze of the ink receiving layer becomes great, and so particularly good color developability can be achieved.

The whole pore volume of the ink receiving layer is favorably 0.50 ml/g or more. When the whole pore volume is 0.50 ml/g or more, it can be well prevented that the ink absorbency of the whole ink receiving layer becomes low, and so excellent ink absorbency can be achieved by controlling the amount of the binder to fine particles of the alumina hydrate as needed.

In addition, pores having a pore radius of 25 nm or more are favorably not present in the pores of the ink receiving layer. In other words, all pores in the ink receiving layer used in the present invention favorably have a pore radium less than 25.0 nm. When no pores having a pore radium of 25 nm or more are present, it can be well prevented that the haze of the ink receiving layer becomes great, and so particularly good color developability can be achieved.

Incidentally, the average pore radius, whole pore volume and pore radius are values determined by means of the BJH (Barrett-Joyner-Halenda) method from an adsorption/desorption isotherm of nitrogen gas obtained by subjecting the ink receiving layer to measurement by the nitrogen adsorption/desorption method. In particular, the average pore radius is a value determined by calculation from the whole pore volume measured upon desorption of nitrogen gas and the specific surface area.

When the recording medium is subjected to the measurement by the nitrogen adsorption/desorption method, the measurement is conducted even for other portions than the ink receiving layer. However, other components (for example, a pulp layer and a resin coating layer of the substrate) than the ink receiving layer do not have pores of 1.0 nm or more and 100.0 nm or less that is a range generally measurable by the nitrogen adsorption/desorption method. Therefore, it is considered that when the whole recording medium is subjected to the measurement by the nitrogen adsorption/desorption method, the average pore radius of the ink receiving layer is measured. Incidentally, this can be understood from the result that when the pore distribution of resin-coated paper is measured by the nitrogen adsorption/desorption method, the resin-coated paper does not have pores of 1.0 nm or more and 100.0 nm or less.

In order to achieve such an average pore radius (7.0 nm or more and 10.0 nm or less) upon the formation of the ink receiving layer as described above, alumina hydrate having a BET specific surface area of 100 m$^2$/g or more and 200 m$^2$/g or less as measured by the BET method is favorably used. Alumina hydrate having a BET specific surface area of 125 m$^2$/g or more and 175 m$^2$/g or less is more favorably used.

The BET method is a method for measuring the surface area of powder by a gas-phase adsorption method, and is a method for determining a total surface area that 1 gram of a sample has, i.e., the specific surface area, from an adsorption isotherm. In the BET method, nitrogen gas is generally used as an adsorption gas, and a method of measuring an adsorption amount from a change in the pressure or volume of the gas to be adsorbed is most often used. At this time, the Brunauer-Emmett-Teller equation is most marked as that indicating the isotherm of multimolecular adsorption, called the BET equation and widely used in determination of the specific surface area. According to the BET method, the specific surface area is determined by finding an adsorption amount based on the BET equation and multiplying this value by an area occupied by one molecule adsorbed on the surface. In the BET method, the relationship between a certain relative pressure and an absorption amount is determined by several measurement points, and the slope and intercept of the plot thereof are found by the least squares method to derive the specific surface area. In the present invention, the relationship between the relative pressure and the absorption amount is determined by five plots to derive the specific surface area.

The favorable shape of the alumina hydrate is such a flat plate that the average aspect ratio is 3.0 or more and 10 or less, and the major-axis to minor-axis ratio of the flat plate surface is 0.60 or more and 1.0 or less. Incidentally, the aspect ratio can be determined according to the method described in Japanese Patent Publication No. H05-16015. More specifically, the aspect ratio is expressed by a ratio of "diameter" to "thickness" of a particle. The term "diameter" as used herein means a diameter of a circle having an area equal to a projected area of the particle (equivalent circle diameter), which has been obtained by observing the alumina hydrate through a microscope or electron microscope. The major-axis to minor-axis ratio of the flat plate surface means a ratio of a minimum diameter to a maximum diameter of the flat plate surface when the particle is observed through the microscope in the same manner as in the aspect ratio.

When the alumina hydrate having an aspect ratio of 3.0 or more and 10 or less is used, it can be well prevented that the pore distribution range of an ink receiving layer to be formed becomes narrow. It can thus be possible to produce alumina hydrate with uniform particle sizes. Even when the alumina hydrate having a major-axis to minor-axis ratio of 0.60 or more and 1.0 or less is used, it can be well prevented likewise that the pore distribution range of an ink receiving layer to be formed becomes narrow.

It is known that alumina hydrate has both ciliary form and another form. According to a finding of the present inventors, the alumina hydrate of the flat plate form has better dispersibility than that of the ciliary form. The alumina hydrate of the ciliary form tends to orient in parallel to the surface of the substrate upon coating, and pores in an ink receiving layer to be formed may become small in some cases, and so the ink absorbency of the ink receiving layer may become low. On the other hand, the alumina hydrate of the flat plate form has a small tendency to orient in parallel to the surface of the substrate upon coating, which has a particularly good influence on the size of pores and ink absorbency of an ink receiving layer to be formed. Thus, the alumina hydrate of the flat plate form is favorably used.

Binder

The ink receiving layer used in the present invention contains a binder. No particular limitation is imposed on a usable binder so far as it is a material capable of binding the alumina hydrate and forming a coating and does not impair the effects of the present invention. Examples of the binder include the following binders: starch derivatives such as oxidized starch, etherified starch, phosphoric acid-esterified starch; cellulose derivatives such as carboxymethyl cellulose and hydroxyethyl cellulose; casein, gelatin, soybean protein and polyvinyl alcohol and derivatives thereof; polyvinyl pyrrolidone, maleic anhydride resins, latexes of conjugated polymers such as styrene-butadiene copolymers and methyl methacrylate-butadiene copolymers, latexes of acrylic polymers such as acrylic ester and methacrylic ester polymers, and latexes of vinyl polymers such as ethylene-vinyl acetate copolymers as various kinds of polymers; functional-group-modified polymer latexes obtained by modifying the above-described polymers with a monomer containing a functional group such as a carboxyl group; cationized polymers obtained by cationizing the above-described polymers with a cationic group or cationizing the surfaces of the polymers with a cationic surfactant; polymers on the surfaces of which polyvinyl alcohol has been distributed obtained by polymerizing the above-described polymers in cationic polyvinyl alcohol; polymers on the surfaces of which cationic colloid particles have been distributed obtained by polymerizing the above-described polymers in a suspended dispersion of the cationic colloid particles; aqueous binders such as thermosetting synthetic resins such as melamine resins and urea resins; polymer or copolymer resins of acrylic esters and methacrylic esters, such as polymethyl methacrylate; and synthetic resin binders such as polyurethane resins, unsaturated polyester resins, vinyl chloride-vinyl acetate copolymers, polyvinyl butyral and alkyd resins.

The binders may be used either singly or in any combination thereof. Among these, polyvinyl alcohol (PVA) is most favorably used. This polyvinyl alcohol can be synthesized by, for example, hydrolyzing polyvinyl acetate. Polyvinyl alcohol having a weight average polymerization degree of 1,500 or more is favorably used, and that having a weight average polymerization degree of 2,000 or more and 5,000 or less is more favorable. The saponification degree thereof is favorably 80% by mol or more and 100% by mol or less, more favorably 85% by mol or more and 100% by mol or less.

Besides the above, modified polyvinyl alcohol such as polyvinyl alcohol with a terminal thereof cationically modified or anionically modified polyvinyl alcohol having an anionic group may also be used.

Since the polyvinyl alcohol is generally obtained by hydrolyzing (saponifying)polyvinyl acetate, an acetate group may partially remain in some cases. Therefore, a hydroxyl group and an acetate group are present at terminals of the polyvinyl alcohol, and the polyvinyl alcohol can be represented by a repeating unit having the hydroxyl group and a repeating unit having the acetate group. When modified polyvinyl alcohol is used, the hydroxyl group and acetate group of the terminal groups of the polyvinyl alcohol are substituted by a substituent such as a cationic group or anionic group. Therefore, the modified polyvinyl alcohol can be represented by a repeating unit having the acetate group, a repeating unit having the hydroxyl group and a repeating unit substituted by the substituent. Polyvinyl alcohol and modified polyvinyl alcohol may be different from each other in saponification degree even when their polymerization degrees are equal to each other. In the modified polyvinyl alcohol, the content of polyvinyl alcohol exhibiting the effect as the binder component may vary in some cases even when its mass is equal to that of polyvinyl alcohol because the modified polyvinyl alcohol contains the repeating unit having the substituent.

Crosslinking Agent

In the recording medium according to the present invention, the ink receiving layer may contain a crosslinking agent described below as needed. Specific examples of the crosslinking agent include aldehyde compounds, melamine compounds, isocyanate compounds, zirconium compounds, amide compounds, aluminum compounds, boric acid and boric acid salts. The crosslinking agent is favorably at least one of these compounds. Among these, boric acid and boric acid salts are particularly favorable as the crosslinking agent from the viewpoints of crosslinking rate and prevention of cracking of a coating surface.

Examples of boric acid usable as the crosslinking agent include not only orthoboric acid ($H_3BO_3$) but also metaboric acid and hypoboric acid. The boric acid salt is favorably a water-soluble salt of the boric acid. Specific examples of the boric acid salt, may include the following boric acid salts: alkali metal salts such as sodium salts ($Na_2B_4O_7.10H_2O$ and $NaBO_2.4H_2O$) of boric acid and potassium salts ($K_2B_4O_7.5H_2O$ and $KBO_2$) of boric acid; ammonium salts ($NH_4B_4O_9.3H_2O$ and $NH_4BO_2$) of boric acid; and the magnesium salts and calcium salts of boric acid.

Among these boric acids and boric acid salts, orthoboric acid is favorably used from the viewpoints of long-term stability of the coating liquid and an inhibitory effect on occurrence of cracking. The amount of the boric acid and boric acid salt used is favorably 10.0% by mass or more and 50.0% by mass or less in terms of total solid content of the boric acid and boric acid salt based on the binder in the resulting ink receiving layer, though the amount may be suitably selected according to production conditions. When the ink receiving layer is formed of 2 or more ink receiving layers as described above, each layer favorably satisfies the range of the above-described solid mass content. When the total solid content of the boric acid and boric acid salt is 50.0% by mass or less, it can be well prevented that the long-term stability of the coating liquid is lowered. The coating liquid is to be used over a long period of time upon production of the ink-absorbent recording medium. When the total solid content is 50.0% by mass or less, a viscosity increase of the coating liquid and the occurrence of gelled products, which are caused when the content of boric acid is too high, can be well prevented even when the coating liquid for ink receiving layers is used for a long period of time. As a result, replacement of the coating liquid or cleaning of a coater head is not frequently required, so that it can be well prevented that productivity is markedly lowered. In addition, when the total solid content is 50.0% by mass or less, it can be well prevented that dot-like surface defects are liable to occur on the resulting ink receiving layer, and so a uniform and particularly good glossy surface can be obtained. When the total solid content is 10.0% by mass or more, occurrence of cracks can be inhibited.

Other Additives

As needed, to the ink receiving layer of the recording medium according to the present invention, may be added various kinds of additives, for example, fixers such as various kinds of cationic resins, flocculants such as polyvalent metal salts, surfactants, fluorescent whitening agents, thickeners, antifoaming agents, foam inhibitors, parting agents, penetrants, lubricants, ultraviolet absorbents, antioxidants, leveling agents, preservatives, pH adjustors, and various kinds of aids publicly known in the technical field of the present invention. The amounts of these additive added may be suitably adjusted.

Examples of usable cationic resins include polyethylene imine resins, polyamine resin, polyamide resins, polyamide epichlorohydrin resins, polyamine epichlorohydrin resins, polyamidopolyamine epichlorohydrin reins, polydiallylamine resins and dicyandiamide condensates. These water-soluble resins may be used either singly or in any combination thereof.

<Coating Liquid>

Coating Liquid for Ink Receiving Layer:

The coating liquid for ink receiving layers contains at least alumina hydrate and a binder and may further contain additives and a dispersion medium such as water. Incidentally, as a specific example of the preparation process of the coating liquid for ink receiving layers, may be mentioned the following process. The coating liquid can be obtained by stirring and mixing an aqueous dispersion of the alumina hydrate, an aqueous solution of the binder and a crosslinking agent.

Dispersion Liquid Containing Alumina Hydrate

The alumina hydrate used in the present invention is contained in the coating liquid for ink receiving layers in a state of an aqueous dispersion deflocculated by a deflocculant. When the alumina hydrate and alumina are used singly, the dispersions in the state of the aqueous dispersions deflocculated by the deflocculant are referred to as an alumina hydrate dispersion and an alumina dispersion, respectively. The dispersion containing the alumina hydrate may contain a pigment dispersant, a thickener, a flowability modifier, an antifoaming agent, a foam inhibitor, a surfactant, a parting agent, a penetrant, a coloring pigment, a coloring dye, a fluorescent whitening agent, an ultraviolet absorbent, an antioxidant, a preservative, a mildew-proofing agent, a water-proofing agent, a dye fixer, a hardener and/or a weathering agent as needed. The dispersion medium of the dispersion containing the alumina hydrate is favorably water. In the present invention, an acid (deflocculating acid) is used as the deflocculant. The deflocculating acid is favorably a sulfonic acid represented by the following formula [I] from the viewpoint of the image bleeding resistance.

$$R^1—SO_3H \qquad \text{General formula [I]}$$

<in the general formula [I], $R^1$ is a hydrogen atom or a branched or unbranched alkyl or alkenyl group having 1 to 3 carbon atoms, with the proviso that $R^1$ may have at least one of an oxo group, halogen atoms, an alkoxy group (—OR) and an acyl group (R—CO—) as a substituent, R in these substituents is a hydrogen atom or an alkyl group having 1 or 2 carbon atoms, and R is not a hydrogen atom when the substituent is an alkoxy group>.

As a process for coating the substrate with the thus-prepared coating liquid for ink-receiving layer, may be applied any conventionally known coating process. For example, coating by a coating method such as a blade coating, air-knife coating, curtain die coating, slot die coating, bar coating, gravure coating or roll coating method is feasible. The two or more ink receiving layers may be formed by sequential coating and drying or by simultaneous multi-layer coating. In particular, simultaneous multi-layer coating by a slide bead system is a favorable method in that productivity is high.

After the coating, drying is conducted by means of a drying device such as a hot air dryer, heated drum or far infrared dryer, whereby the ink receiving layer can be formed. The ink-receiving layer may also be formed on one surface or both surfaces of the substrate described below. In order to improve the resolution of an image formed on the ink-receiving layer and conveyability of the recording medium, the ink-receiving layer may also be subjected to a smoothing treatment by means of a device such as a calendar or cast within limits not impeding the effects of the present invention.

<Partial Coating>

The surface of the ink receiving layer is covered with a partial coating formed by a plurality of coatings containing a cationic polyurethane. For example, an emulsion of the cationic polyurethane is used for forming the partial coating. The cationic polyurethane emulsion (into which various kinds of additives described below are incorporated as needed) is applied (as a coating) to the ink receiving layer and so on (another layer if any) and dried, whereby a solid body of the cationic polyurethane emulsion can be provided as the partial coating.

Cationic Polyurethane Emulsion

The average particle size of the cationic polyurethane emulsion, i.e., the average particle size of particles dispersed in the emulsion, is favorably 0.01 μm or more and 0.10 μm or less. If the average particle size is less than 0.01 μm, the particles dispersed in the emulsion may permeate the ink receiving layer in some cases to make it hard to form the partial coating on the ink receiving layer. If the average particle size is more than 0.10 μm on the other hand, the size of the partial coating which does not absorb an ink becomes large, so that deterioration of appearance may be brought about in some cases upon printing. Incidentally, the average particle size of the cationic polyurethane emulsion used in the present invention is an average particle size measured by a dynamic light scattering method and determined by analysis using a cumulant method described in "Polymer Structure (2); Scattering Experiments and Morphological Observation; First Chapter Light Scattering" (KYORITSU SHUPPAN, edited by The Society of Polymer Science, Japan), or J. Chem. Phys., 70(B), 15 Apl., 3965 (1979). As examples of a dispersion medium of the emulsion, water may be mentioned, and the cationic polyurethane used for forming the partial coating according to the present invention is favorably used in the state of an emulsion dispersed in water. The cationic polyurethane usable in the present invention is favorably a urethane resin having a cationic group such as a primary, secondary or tertiary amine, or a quaternary ammonium salt from the viewpoint of suitability for production. Examples of the cationic polyurethane emulsion used in the present invention include SUPER FLEX 620 and 650 (products of DAI-ICHI KOGYO SEIYAKU CO., LTD.).

Polyurethane:

Polyurethane used in production of the cationic polyurethane will hereinafter be described. Examples of polyurethane applicable to the cationic polyurethane used in the present invention include various kinds of polyurethane synthesized by variously combining the following diol compounds and diisocyanate compounds and subjecting the combined compounds to a polyaddition reaction. The diol compounds and diisocyanate compounds usable in the synthesis of the polyurethane may be respectively used singly. Two or more compounds of the respective compounds may be used in any proportions according to various objects (for example, adjustment of a glass transition temperature (Tg) and improvement in solubility of the resulting polymer, imparting compatibility with a binder, and improvement in stability of a dispersion).

Specific examples of the diol compounds include ethylene glycol, 1,2-propanediol, 1,3-propanediol, 1,2-butanediol, 1,3-butanediol, 2,3-butanediol, 2,2-dimethyl-1,3-propanediol, 1,2-pentanediol, 1,4-pentanediol, 1,5-pentanediol, 2,4-pentanediol, 3,3-dimethyl-1,2-butanediol, 2-ethyl-2-methyl-1,3-propanediol, 1,2-hexanediol, 1,5-hexanediol, 1,6-hexanediol, 2,5-hexanediol, 2-methyl-2,4-pentanediol, 2,2-diethyl-1,3-propanediol, 2,4-dimethyl-2,4-pentanediol, 1,7-heptanediol, 2-methyl-2-propyl-1,3-propanediol, 2,5-dimethyl-2,5-hexanediol, 2-ethyl-1,3-hexanediol, 1,2-octanediol, 1,8-octanediol, 2,2,4-trimethyl-1,3-pentanediol, 1,4-cyclohexanedimethanol, hydroquinone, diethylene glycol, triethylene glycol, dipropylene glycol, tripropylene glycol, polyethylene glycol, polypropylene glycol, polyester polyol, 4,4'-dihydroxydiphenyl-2,2-propane and 4,4'-dihydroxyphenyl sulfone.

Specific examples of the diisocyanate compounds include methylene diisocyanate, ethylene diisocyanate, isophorone diisocyanate, hexamethylene diisocyanate, 1,4-cyclohexane diisocyanate, 2,4-toluene diisocyanate, 2,6-toluene diisocyanate, 1,3-xylylene diisocyanate, 1,5-phenylene diisocyanate, 3,3'-dimethyl-4,4'-diphenylmethane diisocyanate, 3,3'-dimethyldiphenylene diisocyanate, 4,4'-biphenylene diisocyanate, dicyclohexylmethane diisocyanate and methylenebis(4-cyclohexyl isocyanate).

Cationic Polyurethane:

The cationic-group-containing polyurethane (cationic polyurethane) used in the cationic polyurethane emulsion used in the present invention can be obtained by, for example, using a diol having a cationic group upon the synthesis of the polyurethane. In this case, the cationic group is introduced into the polyurethane as a substituent of a main chain of the polymer, whereby the cationic polyurethane can be synthesized. The cationic group of the cationic polyurethane can be introduced into the polyurethane by various methods. The cationic polyurethane can also be synthesized by preparing a polyurethane by a polyaddition reaction, and then causing a cationic-group-containing compound to react with a reactive group remaining at a terminal of the polyurethane, such as an —OH group or amino group, thereby introducing the cationic group. As examples of the cationic-group-containing compound, may be mentioned primary, secondary and tertiary amines and quaternary ammonium salts.

The content of the cationic group in the cationic polyurethane is favorably 0.1 mmol/g or more and 3.0 mmol/g or less, more favorably 0.2 mmol/g or more and 2.0 mmol/g or less. When the content of the cationic group in the cationic polyurethane is 1.0 mmol or more, it can be well prevented that the dispersion stability of the cationic polyurethane becomes low. When the content is 3.0 mmol or less, it can be well prevented that the compatibility of the cationic polyurethane with a binder is lowered.

The mass average molecular weight (Mw) of the cationic polyurethane used in the present invention is generally favorably 1,000 or more and 200,000 or less, more favorably 2,000 or more and 50,000 or less. When the mass average molecular weight is 1,000 or more, the cationic polyurethane can be provided as a particularly stable dispersion. When the mass average molecular weight is 200,000 or less, lowering of solubility and increase of liquid viscosity can be well prevented, and it can be well prevented that the average particle size of the particles in an aqueous dispersion of the cationic polyurethane becomes hard to be controlled to 0.1 μm or less in particular.

Cationic Polyurethane Emulsion:

Water is favorably used as a dispersion medium of the cationic polyurethane emulsion used in the present invention. A preparation method of the aqueous dispersion (emulsion) of the cationic polyurethane using water as a dispersion medium will be described below. The cationic polyurethane resin is mixed with water that is a dispersion medium, additives such as a dispersant are mixed as needed, and the resultant mixture is granulated into fine particles by a dispersing machine, whereby an aqueous dispersion of the cationic polyurethane having an average particle size of 0.10 μm or less can be obtained. As the dispersing machine used for obtaining this aqueous dispersion, may be used conventionally known various dispersing machines such as high-speed rotating dispersing machines, medium-stirring type dispersing machines (for example, ball mill, sand mill and bead mill), ultrasonic dispersing machines, colloid mill dispersing machines and high-pressure dispersing machines. However, medium-stirring type dispersing machines, colloid mill dispersing machines and high-pressure dispersing machines (homogenizers) are favorable from the viewpoint of efficiently conducting dispersion of a cationic polyurethane emulsion to be formed. The content of solids of the cationic polyurethane emulsion in the coating liquid for partial coating is favorably 70% by mass or more based on the total solid content in the coating liquid for partial coating. Incidentally, the content of solids of the cationic polyurethane emulsion in a partial coating formed by applying the coating liquid is equal to the solid content of the cationic polyurethane emulsion based on the total solid content in the coating liquid.

Coverage

The partial coating formed by a plurality of coatings containing a cationic polyurethane has a partial coating structure for retaining excellent properties of the ink receiving layer without impeding the ink absorbency. Incidentally, the partial coating means a coating partially formed on the ink receiving layer without completely closing pores in the surface of the ink receiving layer, not a coating continuously formed on the whole surface of the ink receiving layer. The coverage of the surface of the ink receiving layer by the partial coating is 10% or more and less than 70%, favorably 15% or more and less than 65%. If the coverage of the surface of the ink receiving layer by the partial coating is less than 10%, the effects of gloss development and flaw resistance are lowered. On the other hand, if the coverage of the surface of the ink receiving layer by the partial coating is 70% or more, the area of pores formed in the surface of the ink receiving layer is reduced to lower the ink absorbency. The coverage is determined as an area ratio of the coating portion to the whole surface of the ink receiving layer by conducting image processing on 10 or more observation points (size of a point: 5.00 nm×5.00 nm) of an image through an electron microscope (SEM). The covering by the partial coating is favorably such that the whole surface of the ink receiving layer is substantially uniformly covered. More specifically, when 10 or more points are observed through the electron microscope, it is favorable that the coverages of 70% or more of the points are 10% or more and less than 70%. It is more favorable that the coverages of all points are 10% or more and less than 70%.

Average Major Diameter of Plural Coatings

The average major diameter of the plural coatings is 0.03 μm or more and less than 1.00 μm. The average major diameter of the plural coatings means an average value (number average) was determined by observing an arbitrary 100 coatings in a recording surface (surface having the ink receiving layer (and the partial coating)) through an electron microscope (SEM) and measuring a straight line length from end to end of the coating portion for each coating such that the length is longest. If the average major diameter of the plural coatings is less than 0.03 μm, the effects of gloss development and flaw resistance are lowered. On the other hand, if the average major diameter of the plural coatings is 1.00 μm or more, the pores formed in the surface of the ink receiving layer are closed over a wide range, and when printed thereon, wide coatings incapable of absorbing ink are conspicuous to deteriorate appearance. The average major diameter of the plural coatings is favorably 0.05 μm or more, more favorably 0.08 μm or more.

Coating Liquid for Partial Coating

As the coating liquid for partial coating used for forming the partial coating, may be used, for example, the above-described cationic polyurethane emulsion. Various kinds of additives may be added into the cationic polyurethane emulsion as the coating liquid for partial coating within limits not impeding the effects of the present invention. As examples of such additives, may be mentioned surfactants, thickeners, antifoaming agents, dot adjusters, preservatives, pH adjustors, antistatic agents and conductivity-imparting agents.

As a process for forming the partial coating, may be mentioned, for example, the following process. The process is a process of forming an ink receiving layer and a partial coating at the same time by simultaneously applying a coating liquid for ink receiving layers and the cationic polyurethane emulsion as a coating liquid for partial coating on the ink receiving layer and drying both at the same time, or a process of applying as an overcoat the cationic polyurethane emulsion as a coating liquid for partial coating after providing an ink receiving layer and drying it, thereby forming a partial coating. Of these processes, the process of applying as an overcoat the cationic polyurethane emulsion as the coating liquid for partial coating after providing the ink receiving layer to provide the partial coating is favorable. According to this process, mixing with the coating liquid for ink receiving layers can be avoided to more efficiently provide the partial coating. In addition, increase in haze by mixing of the cationic polyurethane emulsion with the coating liquid for ink receiving layers can be well inhibited to particularly prevent lowering of color developability.

The coating amount of the partial coating on the whole surface of the ink receiving layer is favorably 0.01 g/m$^2$ or more and 0.10 g/m$^2$ or less from the viewpoint of controlling the coverage of the surface of the ink receiving layer with the partial coating to 10% or more and less than 70%.

If the average particle size of particles dispersed in the cationic polyurethane emulsion is smaller than the pore size of the ink receiving layer, the amount of the particles dispersed in the cationic polyurethane emulsion to permeate the ink receiving layer becomes great. Thus, the coating amount of the cationic polyurethane emulsion needs to be increased for forming such a partial coating that the coverage is 10% or more and less than 70%. When the average particle size of particles dispersed in the cationic polyurethane emulsion is greater than the pore size of the ink receiving layer, the amount of the particles dispersed in the cationic polyurethane emulsion to permeate the ink receiving layer becomes small, so that the partial coating can be formed even in a small coating amount so as to give the above-described coverage. Thus, the average particle size of the cationic polyurethane emulsion is favorably 0.01 μm or more and 0.10 μm or less.

EXAMPLES

The present invention will hereinafter be described in more detail by the following Examples. However, the present invention is not limited to these examples. Incidentally, ink jet recording media were prepared in the following Examples and Comparative Examples.

Example 1

Substrate

A substrate was prepared under the following conditions. A paper stock of the following composition was first adjusted with water so as to give a solid content concentration of 3.0% by mass.

Composition of Paper Stock

| | |
|---|---|
| Pulp slurry (80.00 parts by mass of Laulholz bleached kraftpulp (LBKP) having a freeness of 450 ml CSF (Canadian Criteria Freeness) and 20.00 parts by mass of Nadelholz bleached kraft pulp (NBKP) having a freeness of 480 ml CSF) | 100.00 parts by mass |
| Cationized starch | 0.60 parts by mass |
| Ground calcium carbonate | 10.00 parts by mass |
| Precipitated calcium carbonate | 15.00 parts by mass |
| Alkyl ketene dimer | 0.10 parts by mass |
| Cationic polyacrylamide | 0.03 parts by mass. |

Paper was then made from this paper stock by a Fourdrinier paper machine, subjected to 3-stage wet pressing and dried by a multi-cylinder dryer. The resultant paper was then impregnated with an aqueous solution of oxidized starch by a size pressing machine so as to give a coating amount of 1.0 g/m$^2$, and dried. Thereafter, the paper was finished by a machine calendar to obtain a base paper having a basis weight of 170 g/m$^2$, a Stöckigt sizing degree of 100 seconds, a gas permeability of 50 seconds, a Bekk smoothness of 30 seconds and a Gurley stiffness of 11.0 mN.

A resin composition composed of low density polyethylene (70 parts by mass), high density polyethylene (20 parts by mass) and titanium oxide (10 parts by mass) was applied in an amount of 25 g/m$^2$ on the base paper thus obtained. A resin composition composed of high density polyethylene (50 parts by mass) and low density polyethylene (50 parts by mass) was further applied in an amount of 25 g/m$^2$ on a back side of the base paper, thereby obtaining a resin-coated substrate.

<Ink Receiving Layer>

A coating liquid for ink receiving layers of the following composition, which had been adjusted with water so as to give a solid content concentration of 20% by mass, was applied on the substrate by a slide die so as to give a dry coating amount of 35 g/m$^2$ and then dried at 80° C. by a dryer to provide an ink receiving layer.

| | |
|---|---|
| Methanesulfonic acid | 1.5 parts by mass |
| Boric acid | 2.5 parts by mass |
| Polyvinyl alcohol | 9.0 parts by mass |

(product of Kuraray Co., Ltd., saponification degree: 88% by mol, weight average polymerization degree: 3,500,)

(product of Kuraray Co., Ltd., saponification degree: 88% by mol, weight average polymerization degree: 3,500)

<Partial Coating>

An aqueous dispersion (trade name: SUPER FLEX 620, product of DAI-ICHI KOGYO SEIYAKU CO., LTD.) of cationic polyurethane having an average particle size of 0.03 μm was added so as to give a solid content of 0.50% by mass based on a coating liquid. A surfactant (trade name: TDX-50, product of DAI-ICHI KOGYO SEIYAKU CO., LTD.) was further added so as to give a solid content of 0.005% by mass based on the coating liquid to prepare a cationic polyurethane emulsion as a coating liquid for partial coating. This emulsion was applied as an overcoat on the surface of the ink receiving layer by a Meyer Bar in such a manner that the coating amount (dry coating amount) of a partial coating on the whole surface of the ink receiving layer is 0.010 g/m$^2$, and then dried for 20 minutes at 60° C. by a dryer to prepare Recording Medium 1 according to the present invention. Incidentally, the above-described coating amount will hereinafter be regarded as a dry coating amount of the partial coating.

Example 2

Recording Medium 2 was prepared under the same conditions as in Example 1 except that the dry coating amount of the partial coating was changed to 0.020 g/m$^2$.

Example 3

Recording Medium 3 was prepared under the same conditions as in Example 1 except that the dry coating amount of the partial coating was changed to 0.050 g/m$^2$.

Example 4

Recording Medium 4 was prepared under the same conditions as in Example 1 except that the dry coating amount of the partial coating was changed to 0.100 g/m$^2$.

Example 5

Recording Medium 5 was prepared under the same conditions as in Example 2 except that the aqueous dispersion of the cationic polyurethane used in the partial coating was changed to an aqueous dispersion of a cationic polyurethane having an average particle size of 0.01 μm (trade name: SUPER FLEX 650, product of DAI-ICHI KOGYO SEIYAKU CO., LTD.).

Example 6

Recording Medium 6 was prepared under the same conditions as in Example 5 except that the dry coating amount of the partial coating was changed to 0.050 g/m$^2$.

Example 7

Recording Medium 7 was prepared under the same conditions as in Example 3 except that the aqueous dispersion of the cationic polyurethane used in the partial coating was changed to an aqueous dispersion of a cationic polyurethane having an average particle size of 0.07 μm. (trade name: HYDRAN CP7060, product of DIC Corporation)

Comparative Example 1

Recording Medium 8 was prepared in the same manner as in Example 1 except that no partial coating was provided.

Comparative Example 2

Recording Medium 9 was prepared under the same conditions as in Example 3 except that the aqueous dispersion of the cationic polyurethane used in the partial coating was changed to an aqueous dispersion of a cationic polyurethane having an average particle size of 0.2 μm (trade name: HYDRAN CP7040, product of DIC Corporation).

Comparative Example 3

Recording Medium 10 was prepared under the same conditions as in Example 3 except that the aqueous dispersion of the cationic polyurethane used in the partial coating was changed to an aqueous dispersion of an anionic polyurethane having an average particle size of 0.03 μm (trade name: SUPER FLEX 840, product of DAI-ICHI KOGYO SEIYAKU CO., LTD.).

Comparative Example 4

Recording Medium 11 was prepared under the same conditions as in Example 3 except that the aqueous dispersion of the cationic polyurethane used in the partial coating was changed to an SBR latex having an average particle size of 0.07 μm (trade name: SMARTEX PA-3232, product of NIPPON A&L INC.).

Comparative Example 5

Recording Medium 12 was prepared under the same conditions as in Example 3 except that the aqueous dispersion of the cationic polyurethane used in the partial coating was changed to an aqueous solution of polyvinyl alcohol (trade name: PVA 235, product of Kuraray Co., Ltd.). In Comparative Example 5, the polyvinyl alcohol was impregnated into the ink receiving layer, and so no coating (partial coating or complete coating) could be formed.

Comparative Example 6

Recording Medium 13 was prepared under the same conditions as in Example 1 except that the added amount of the aqueous dispersion of the cationic polyurethane used in the partial coating dry coating was changed to 0.35% by mass, and the coating amount (dry coating amount) of the partial coating on the whole surface of the ink receiving layer was changed to 0.007 g/m$^2$.

Comparative Example 7

Recording Medium 14 was prepared under the same conditions as in Example 2 except that the aqueous dispersion of the cationic polyurethane used in the partial coating was changed to an aqueous dispersion of a cationic polyurethane having an average particle size of 0.2 μm (trade name: HYDRAN CP7040, product of DIC Corporation).

Evaluation of Recording Medium

The above-described recording media were subjected to the following evaluations. Incidentally, Evaluations 1 and 2 were not made on Recording media 8 and 12 because the recording media had no coating (partial coating and complete coating). Evaluating methods are described. Evaluated results on the respective evaluation methods for the respective recording media are shown collectively in Table 1.

Evaluation 1 Coverage by Partial Coating

Whether a recording surface (surface having an ink receiving layer (and a partial coating)) of each of the recording media obtained above was a partial coating or a complete coating was first determined. The whole surface was first observed at a 30,000 magnification through an electron microscope (SEM, S-4300 (trade name), manufactured by Hitachi Co.) to determine it to be a complete coating where pores in the ink receiving layer were completely closed and not observed or to be a partial coating where pores in the ink receiving layer were partially observed.

When the recording surface was determined to be a partial coating, 10 or more points of the recording surface were observed at a 30,000 magnification. The resultant images were respectively read into Adobe Photoshop (trade name) to adjust the pores and alumina hydrate in the surface of the ink receiving layer, and the coating containing the cationic polyurethane emulsion covering the surface so as to obtain contrast. The proportion of the brightness of the coating containing the cationic polyurethane emulsion covering the surface was then determined from a brightness histogram to determine the average value of the images at the 10 or more points as a coverage of each recording medium.

Evaluation 2 Average Major Diameter of Partial Coating

With respect to a recording surface (surface having an ink receiving layer (and a partial coating)) of each of the recording media obtained above, arbitrary 100 coatings in the recording surface were observed at a 30,000 magnification through an electron microscope (SEM, S-4300 (trade name), manufactured by Hitachi Co.). The average value determined by measuring a straight line length from end to end of the coating portion for each partial coating of each recording medium such that the length is longest was regarded as an average major diameter.

Evaluation 3 Surface Glossiness

With respect to a recording surface (surface having an ink receiving layer (and a partial coating)) of each of the recording media obtained above, the 75° gloss was measured by means of a gloss meter (trade name: VG-2000, manufactured by Nippon Denshoku Kogyo K.K.) and evaluated according to the following evaluation criteria.

Evaluation Criteria:
5: 80 or more;
4: 70 or more and less than 80;
3: 60 or more and less than 70;
2: 50 or more and less than 60;
1: less than 50.

Evaluation 4 Flaw Resistance

With respect to a recording surface of each of the recording media obtained above, the flaw resistance was evaluated by means of Gakushin-Type Rubbing Tester Model II (manufactured by TESTER SANGYO CO., LTD.) prescribed in JIS L 0849 as follows.

The recording medium was set as a specimen on a vibrating table with the recording surface (surface of an ink receiving layer (and a partial coating)) being upward, and KIMTOWEL (trade name) was installed on the friction arm of the tester, on which a weight of 100 g had been placed, and rubbed against the recording medium 5 times. Thereafter, the difference in 70° gloss between the rubbed portion in the recording surface of the recording medium and another portion was measured.

Evaluation Criteria:
A: less than 10;
B: 10 or more and less than 20;
C: 20 or more.

Evaluation 5 Color Developability

A black solid patch was printed on a recording surface of each of the recording media prepared above by means of an ink jet recording apparatus (trade name: iP4500, manufactured by Canon Inc.) by a mode of Super Photopaper and no color correction. The optical densities of the patches thus printed were respectively measured by means of an optical reflection densitometer (trade name: 530 SPECTRAL DENSITOMETER, manufactured by X-Rite Co.).

Evaluation Criteria:
5: 2.35 or more;
4: 2.25 or more and less than 2.35;
3: 2.15 or more and less than 2.25;
2: 2.05 or more and less than 2.15;
1: less than 2.05.

Evaluation 6 Evaluation of Ink Absorbency

The ink absorbency of a recording surface (surface having an ink receiving layer (and a partial coating)) of each of the recording media obtained above was evaluated. Printing was conducted by means of an apparatus obtained by modifying the print processing system of iP4600 (trade name, manufactured by Canon Inc.). Evaluation was made by using print pattern of a green 64-gradation solid print (64 gradations with 6.25%-duty increment, 0 to 400% duty) by such bi-directional printing that printing is completed by reciprocating 2-pass scans at a carriage speed of 25 in/sec. Incidentally, the 400% duty means that 44 ng of an ink is applied to a 600 dpi-square (a square of 1 square inch with 600 dpi). Since the ink absorbency has correlation with beading, the beading was evaluated, whereby the ink absorbency of the recording medium was evaluated. The evaluation was visually made to determine the rank of the recording medium based on the following evaluation criteria. As apparent from Table 1, the recording media according to the present invention have sufficient ink absorbency to use even at a printing speed of a next-generation high-speed printer.

Evaluation Criteria:
A: No beading is observed at 300% duty;
B: Beading is somewhat observed at 300% duty, but no beading is observed at 200% duty;
C: Beading is observed even at 200% duty.

TABLE 1

| | Average major diameter of partial coating μm | Coverage % | Evaluation | | | |
|---|---|---|---|---|---|---|
| | | | Gloss | Ink absorbency | Flaw resistance | Color developability |
| Ex. 1 | 0.04 | 10 | 3 | A | B | 5 |
| Ex. 2 | 0.08 | 15 | 5 | A | A | 5 |
| Ex. 3 | 0.20 | 30 | 5 | A | A | 5 |
| Ex. 4 | 0.50 | 60 | 5 | A | A | 5 |
| Ex. 5 | 0.07 | 15 | 4 | A | A | 5 |
| Ex. 6 | 0.15 | 28 | 5 | A | A | 5 |
| Ex. 7 | 0.70 | 35 | 5 | A | A | 5 |
| Comp. Ex. 1 | — | — | 2 | A | C | 5 |
| Comp. Ex. 2 | 2.00 | 88 | 5 | C | A | 2 |
| Comp. Ex. 3 | 0.20 | 30 | 1 | A | B | 2 |
| Comp. Ex. 4 | 0.70 | 40 | 3 | B | B | 2 |
| Comp. Ex. 5 | — | — | 3 | C | C | 4 |
| Comp. Ex. 6 | 0.04 | 8 | 2 | A | C | 5 |
| Comp. Ex. 7 | 1.20 | 55 | 5 | B | A | 3 |

According to the present invention, there are provided recording media having excellent surface glossiness, flaw resistance and color developability while retaining excellent ink absorbency of the ink receiving layer.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-253937, filed Nov. 5, 2009, which is hereby incorporated by reference herein in its entirety.

What is claimed is:

1. A recording medium comprising a substrate and an ink receiving layer that is provided on the substrate and contains alumina hydrate and a binder, wherein a surface of the ink receiving layer is covered with a partial coating formed by a plurality of coatings containing a cationic polyurethane, the plurality of coatings have an average major diameter of 0.03 μm or more and less than 1.00 μm, and the partial coating provides a coverage of 10% or more and less than 70% with respect to the surface of the ink receiving layer.

2. The recording medium according to claim 1, wherein the partial coating is a solid body of a cationic polyurethane emulsion having an average particle size of 0.01 μm or more and 0.10 μm or less.

* * * * *